US007140117B1

(12) United States Patent
Weiss

(10) Patent No.: US 7,140,117 B1
(45) Date of Patent: Nov. 28, 2006

(54) DARTBOARD POSITIONING DEVICE AND METHOD

(76) Inventor: Anthony J. Weiss, P.O. Box 790, Islip Terrace, NY (US) 11752

( * ) Notice: Subject to any disclaimer, the term of this patent is extended or adjusted under 35 U.S.C. 154(b) by 0 days.

(21) Appl. No.: 11/154,609

(22) Filed: Jun. 17, 2005

(51) Int. Cl.
*G01C 15/00* (2006.01)
*F41J 5/02* (2006.01)

(52) U.S. Cl. ..... 33/286; 273/371; 33/506; 33/276; 33/DIG. 21

(58) Field of Classification Search ..... 33/286, 33/289, 276, 277, 506, DIG. 21; 116/222; 273/371, 372, 373, 374, 375, 376
See application file for complete search history.

(56) References Cited

U.S. PATENT DOCUMENTS

| | | | | |
|---|---|---|---|---|
| 685,455 | A * | 10/1901 | Kinkead | 33/286 |
| 3,603,688 | A * | 9/1971 | Smith-Vaniz | 33/286 |
| 3,741,662 | A | 6/1973 | Pioch | |
| 3,752,588 | A | 8/1973 | Chapman | |
| 3,909,952 | A * | 10/1975 | Lagasse | 33/286 |
| 3,970,391 | A * | 7/1976 | Johnson et al. | 33/286 |
| 3,972,622 | A * | 8/1976 | Mason et al. | 33/286 |
| 4,155,648 | A * | 5/1979 | Ferguson | 33/286 |
| 4,974,857 | A | 12/1990 | Beall et al. | |
| 5,294,912 | A | 3/1994 | Bednarz et al. | |
| 5,660,470 | A * | 8/1997 | Mench | 33/286 |
| D403,361 | S | 12/1998 | Huang | |
| D446,877 | S | 8/2001 | Lester | |
| 6,502,319 | B1 | 1/2003 | Goodrich et al. | |
| 6,609,307 | B1 | 8/2003 | Haynes et al. | |
| 6,735,879 | B1 * | 5/2004 | Malard et al. | 33/286 |
| 6,826,841 | B1 * | 12/2004 | Liao | 33/286 |
| 2001/0029675 | A1 * | 10/2001 | Webb | 33/286 |
| 2002/0017028 | A1 * | 2/2002 | Wishart | 33/286 |
| 2006/0038350 | A1 * | 2/2006 | Weber | 273/371 |
| 2006/0042105 | A1 * | 3/2006 | McGrail et al. | 33/286 |

FOREIGN PATENT DOCUMENTS

| | | | |
|---|---|---|---|
| DE | 19924915 | A1 * | 12/2000 |
| EP | 697579 | A1 * | 2/1996 |
| WO | WO 9102217 | A * | 2/1991 |

* cited by examiner

*Primary Examiner*—Diego Gutierrez
*Assistant Examiner*—Travis Reis

(57) ABSTRACT

A dartboard positioning device and method includes a housing that has a back wall, a front wall, a first side wall, a second side wall, a top wall and a bottom wall. The back wall is arcuate and abuttable against an edge of a dartboard. A center mark indicator is positioned on the first side wall. A distance measuring assembly is positioned in the housing and is adapted for determining a distance from the center mark indicator to a selectable point. A laser pointer mounted on the first side wall defines the center mark indicator and is adapted for directing a point of light away from the housing. The laser pointer is angled with respect to the housing so that the point of light strikes a floor surface spaced 7' 9.25" from the first side wall when the center mark indicator is positioned 5' 8" above the floor surface.

7 Claims, 5 Drawing Sheets

DARTBOARD POSITIONING DEVICE AND METHOD

BACKGROUND OF THE INVENTION

1. Field of the Invention

The present invention relates to measuring devices and more particularly pertains to a new measuring device for aiding a person in simultaneously determining the correct height of a dartboard and the proper distance between the dartboard and a toe line marker.

2. Description of the Prior Art

The use of measuring devices is known in the prior art. U.S. Pat. No. 3,752,588 describes a device adapted for indicating the distance between first down markers on a football field. Another type of measuring device is U.S. Pat. No. 3,741,662, which measures first down distance and which also emits a visible lie on a football field. Another such device is shown in U.S. Pat. No. 6,609,307 which includes an assembly adapted for aiding a person in determining proper placement of a pool rack on a pool table.

While these devices fulfill their respective, particular objectives and requirements, the need remains for a device that allows a person to not only measure a proper height for the positioning of a dartboard on a wall, but that also provides and indication of where a toe line marker is to be drawn so that a person using the dartboard knows the proper distance to be standing from the dartboard. It is preferred that both of these measurements may be taken simultaneously to allow a more accurate, as well as more efficient, measurement.

SUMMARY OF THE INVENTION

The present invention meets the needs presented above by generally comprising a device adapted for being abutted against a perimeter edge of a dartboard and determining the correct height and throwing distance for the dartboard. The device includes a housing that has a back wall, a front wall, a first side wall, a second side wall, a top wall and a bottom wall. The back wall is arcuate and has a contoured surface adapted for being abuttable against the perimeter edge of the dartboard. A center mark indicator is positioned on the first side wall. A distance measuring assembly is positioned in the housing and is adapted for determining a distance from the center mark indicator to a selectable point spaced from the housing. A laser pointer defines mounted on the first side wall defines the center mark indicator and is adapted for directing a point of light away from the housing. The laser pointer is angled with respect to the housing so that the point of light strikes a floor surface spaced 7' 9.25" from the first side wall when the center mark indicator is positioned 5' 8" above the floor surface. The back wall may be positioned against the perimeter edge of the dartboard so that the bottom wall faces downward and the center mark indicator is horizontally aligned with a bull's-eye of the dartboard. The dartboard may be positioned so that the distance measuring assembly indicates the center mark indicator is 5' 8" from the floor surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
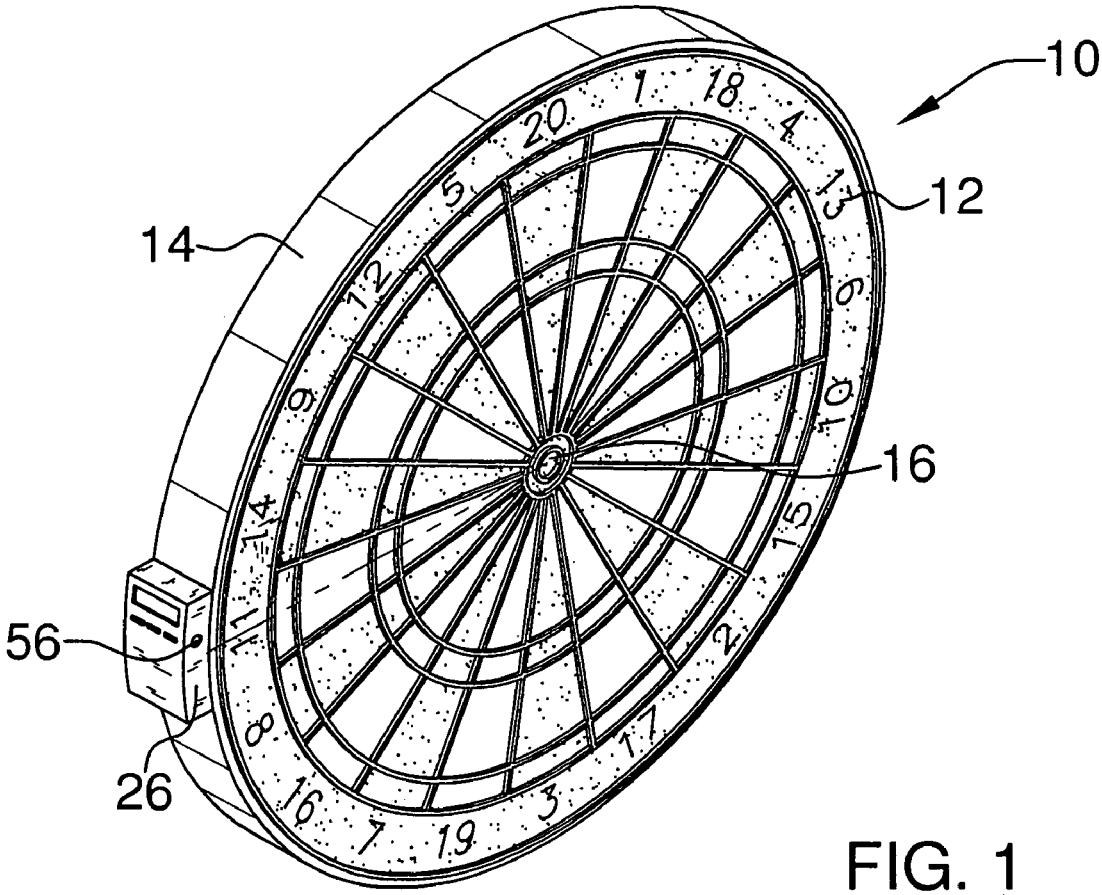
FIG. 1 is a perspective front, in-use view of a dartboard positioning device and method according to the present invention.
Figure 2:
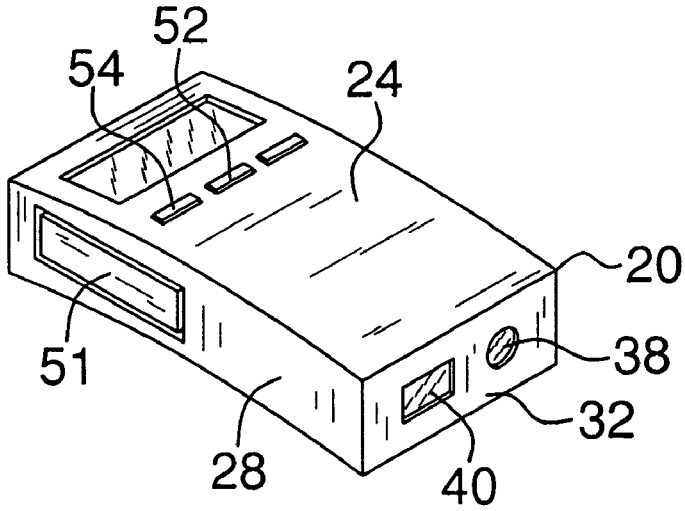
FIG. 2 is a perspective side view of the present invention.
Figure 3:
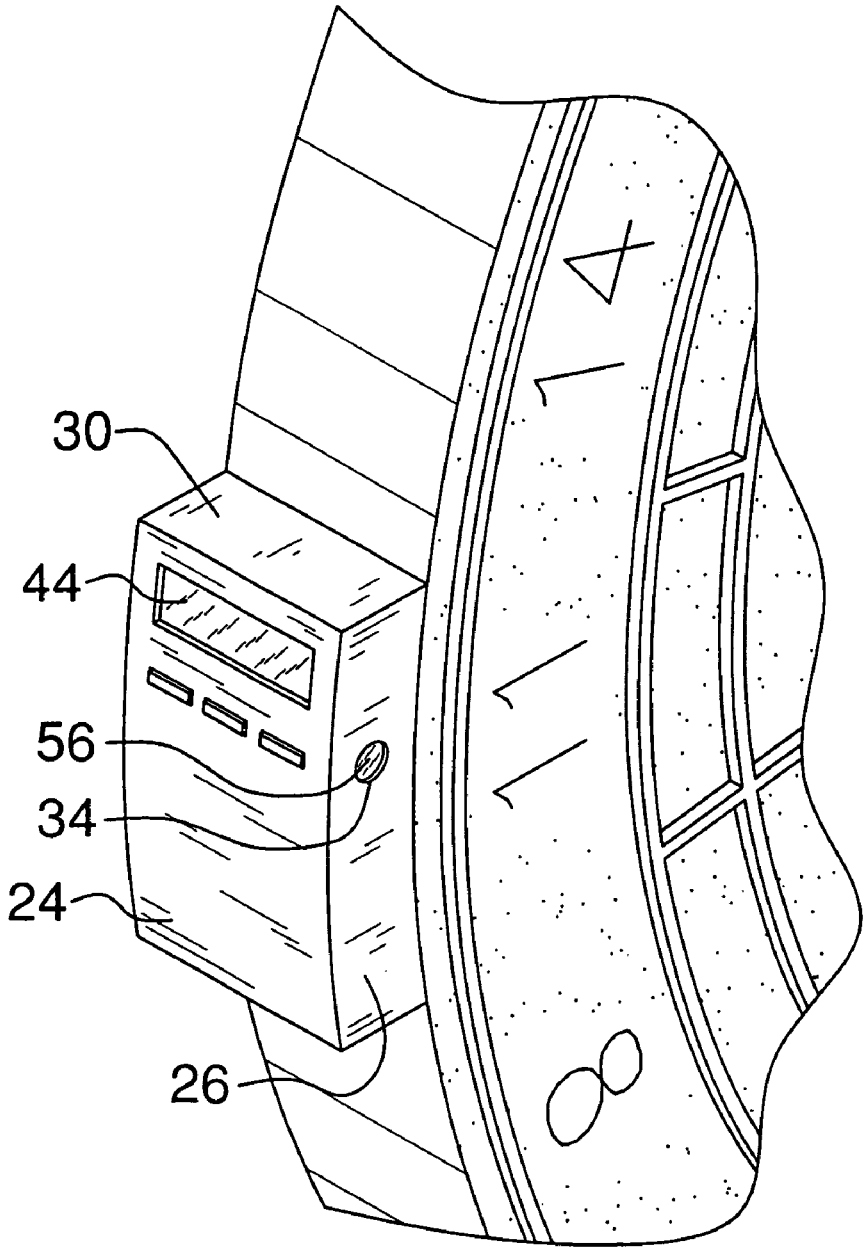
FIG. 3 is a perspective front, in-use view of the present invention.
Figure 4:
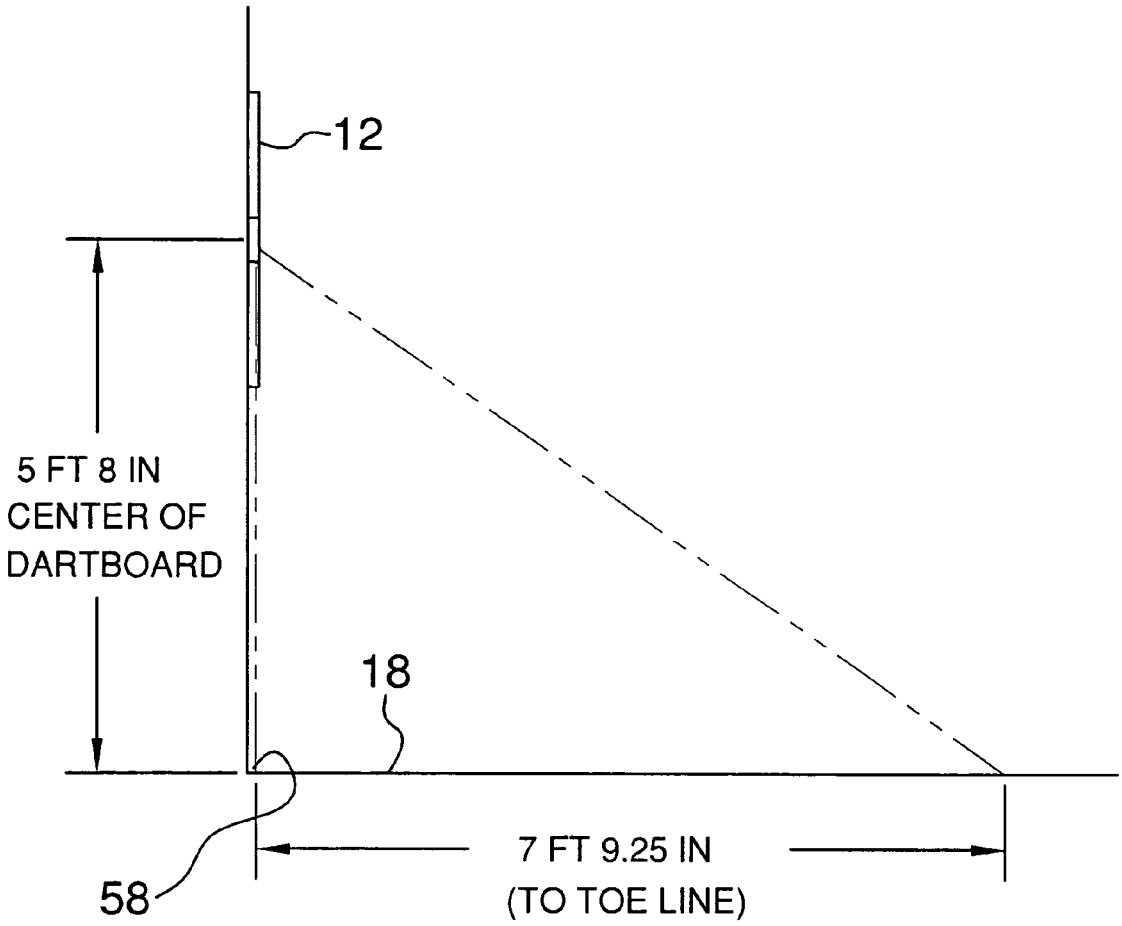
FIG. 4 is a side in-use view of the present invention.
Figure 5:
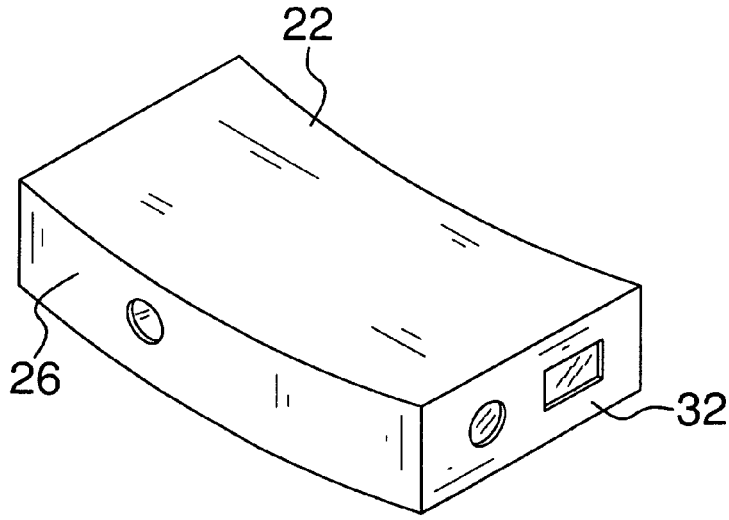
FIG. 5 is a rear perspective view of the present invention.
Figure 6:
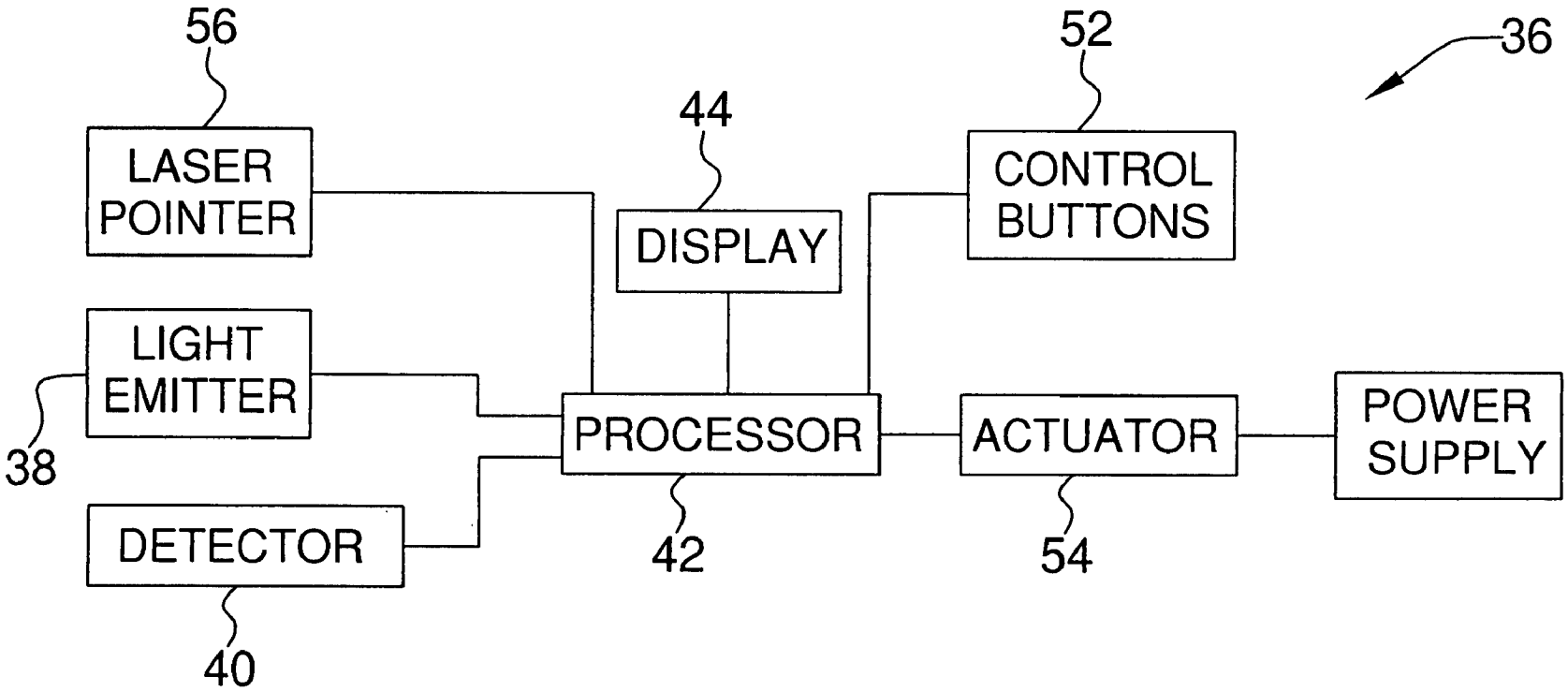
FIG. 6 is a schematic view of a first embodiment of the present invention.
Figure 7:
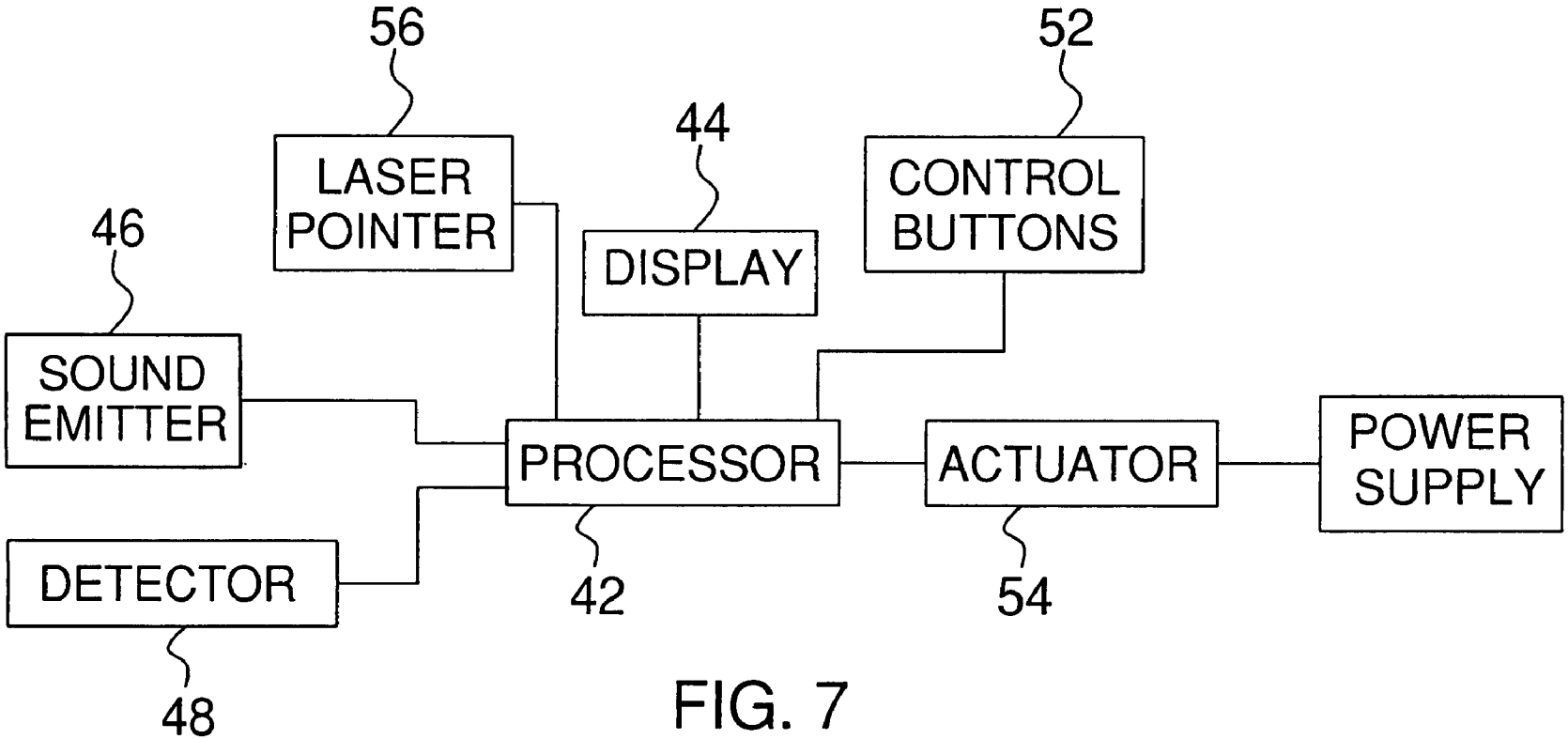
FIG. 7 is a schematic view of a second embodiment of the present invention.

With reference now to the drawings, and in particular to FIGS. 1 through 7 thereof, a new measuring device embodying the principles and concepts of the present invention and generally designated by the reference numeral 10 will be described.

As best illustrated in FIGS. 1 through 7, the dartboard positioning device and method 10 generally comprises a device and method for determining the distance of a dartboard 12 from a floor surface and the correct distance from which one should be standing when tossing darts at the dartboard 12. The dartboard 12 has perimeter edge 14 which is rounded in a conventional manner.

The device 10 includes a housing 20 that has a back wall 22, a front wall 24, a first side wall 26, a second side wall 28, a top wall 30 and a bottom wall 32. At least one of the walls is arcuate so that it may be abuttable against the perimeter edge 14 of the dartboard 12. It is preferred that the arcuate wall is the back wall 22 and that the back wall 22 has a contoured surface adapted for being abuttable against the perimeter edge 14 of the dartboard 12. A center mark indicator 34 is positioned on the first side wall 28, though the center mark indicator 34 may be any indicia on the housing 20 that may be centered with the dartboard as further described below.

A distance measuring assembly 36 is positioned in the housing 20 and is adapted for determining a distance from the center mark indicator 34 to a selectable point spaced from the housing 20. The distance measuring assembly includes a light emitter 38 that is directed outwardly of the bottom wall 32. The light emitter 38 is preferably a laser light emitter. A detector 40 is adapted for receiving light emitted by the light emitter 38 that is reflected off of the selectable point. A processor 42 is electrically coupled to the detector 40 and the light emitter 38. The processor 42 is adapted for determining the distance between the center mark indicator 34 and the selectable point. A display 44 is mounted on the housing 20 and is electrically coupled to the processor 42. The display 44 is adapted for displaying the distance determined by the processor 42. The display 44 is preferably a liquid crystal display.

Alternatively, the distance measuring assembly may include a sound emitter 46 that is directed outwardly of the bottom wall 32. A detector 48 is adapted for receiving sound emitted by the sound emitter 46 that is reflected off of the selectable point. A processor 42 is again electrically coupled to the detector 48 and the sound emitter 46 and is adapted for determining the distance between the center mark indicator 34 and the selectable point. A display 44 is again mounted on the housing 20 and is electrically coupled to the processor 45. The display 44 in both versions is preferably a liquid crystal display. The sound emitting and light emitting versions are each generally conventional distance measuring devices which use either reflected light or sound to determine distance between two points.

A power supply 50 is electrically coupled to the processor 42 and preferably comprises a rechargeable battery accessible through a door 51 in the housing 20. An actuator 54 is operationally coupled to the power supply 50 for selectively turning the power on or off to the processor 42.

A laser pointer 56 is mounted on the front wall 24. The laser pointer may be positioned in the located for the center mark indicator 34 so that it may define the center mark indicator 34. The laser pointer 56 is for directing a point of light 58 away from the housing 20. The laser pointer 56 is angled with respect to the housing so that the point of light 58 strikes a floor surface spaced 7' 9.25" from the first side wall 26 when the center mark indicator 34 is positioned 5' 8" above a floor surface 18. Control buttons 52 may be mounted on the housing 20 and electrically coupled to the processor 42 for selectively turning off the laser pointer or turning off or resetting the distance measuring assembly 36 as desired.

In use, the back wall 22 is positioned against the perimeter edge 14 of the dartboard 12 so that the bottom wall 32 faces downward and the center mark indicator 34 is horizontally aligned with a bull's-eye 16 of the dartboard 12. The dartboard 12 is then positioned on a wall so that the distance measuring assembly 36 indicates that the center mark indicator 34 is located 5' 8" from the floor surface. Once the proper height is determined, a toe line marking is made which intersects the point of light 58. This toe line marking will give the proper distance between the dartboard 12 and a person throwing darts at the dartboard 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of measuring a relative height and distance from a dartboard mounted on a wall, the dartboard having a perimeter edge, said method comprising the steps of:

providing a housing having a back wall, a front wall, a first side wall, a second side wall, a top wall and a bottom wall, said back wall being arcuate and having a contoured surface adapted for being abuttable against the perimeter edge of the dartboard;

providing a distance measuring assembly being positioned in said bottom wall of said housing and being adapted for determining a distance from a center mark indicator to a selectable point spaced from said housing;

providing a laser pointer being mounted on said first side wall and defining said center mark indicator, said laser pointer being adapted for directing a point of light away from said housing, said laser pointer being angled with respect to said housing such that said point of light strikes a floor surface spaced 7' 9.25" from said first side wall when said laser pointer is positioned 5' 8" above the floor surface;

positioning said back wall against said perimeter edge of the dartboard such that said bottom wall faces downward and said laser pointer is horizontally aligned with a bull's-eye of the dartboard;

positioning said dartboard such that said distance measuring assembly indicates said laser pointer is 5' 8" from the floor surface; and making a toe line marking at a point wherein said floor surface intersects said point of light.

2. The method according to claim 1, wherein said distance measuring assembly includes:

a light emitter being directed outwardly of said bottom wall, said light emitter being a laser light emitter;

a detector being adapted for receiving light emitted by said light emitter that is reflected off of said selectable point;

a processor being electrically coupled to said detector and said light emitter and being adapted for determining the distance between said center mark indicator and said selectable point; and a display being mounted on said housing and being electrically coupled to said processor, said display being adapted for displaying the distance determined by said processor.

3. The method according to claim 1, wherein said distance measuring assembly includes:

a sound emitter being directed outwardly of said bottom wall;

a detector being adapted for receiving sound emitted by said sound emitter that is reflected off of said selectable point;

a processor being electrically coupled to said detector and said sound emitter and being adapted for determining the distance between said center mark indicator and said selectable point; and a display being mounted on said housing and being electrically coupled to said processor, said display being adapted for displaying the distance determined by said processor.

4. A method of measuring a relative height and distance from a dartboard mounted on a wall, the dartboard having a perimeter edge, said method comprising the steps of:

providing a housing having a back wall, a front wall, a first side wall, a second side wall, a top wall and a bottom wall, said back wall being arcuate and having a contoured surface adapted for being abuttable against the perimeter edge of the dartboard, a center mark indicator being positioned on said first wall;

providing a distance measuring assembly being positioned in said housing and being adapted for determining a distance from said center mark indicator to a selectable point spaced from said housing, said distance measuring assembly including;

a light emitter being directed outwardly of said bottom wall, said light emitter being a laser light emitter;

a detector being adapted for receiving light emitted by said light emitter that is reflected off of said selectable point;

a processor being electrically coupled to said detector and said light emitter and being adapted for determining the distance between said center mark indicator and said selectable point;

a display being mounted on said housing and being electrically coupled to said processor, said display being adapted for displaying the distance determined by said processor;

providing a laser pointer being mounted on said first side wall and defining said center mark indicator, said laser pointer being adapted for directing a point of light away from said housing, said laser pointer being angled with respect to said housing such that said point of light strikes a floor surface spaced 7' 9.25" from a plane of said first side wall when said laser pointer is positioned 5' 8" above the floor surface;

positioning said back wall against said perimeter edge of the dartboard such that said bottom wall faces downward and said laser point is horizontally aligned with a bull's-eye of the dartboard;

positioning said dartboard such that said distance measuring assembly indicates said laser pointer is 5' 8" from the floor surface; and making a toe line marking at a point where said floor surface intersects said point of light.

5. A measuring apparatus for measuring a relative height and distance from a dartboard mounted on a wall, the dartboard having a perimeter edge, said apparatus comprising:

a housing having a back wall, a front wall, a first side wall, a second side wall, a top wall and a bottom wall, at least one of said walls of said housing being arcuate and being adapted for being abuttable against the perimeter edge of the dartboard, a center mark indicator being mounted on said housing;

a distance measuring assembly being positioned in said bottom wall of said housing and being adapted for determining a distance from said center mark indicator to a selectable point spaced from said housing;

a laser pointer being mounted on said housing and defining said first side wall of said center mark indicator, said laser pointer being adapted for directing a point of light away from said housing, said laser pointer being angled with respect to said housing such that said point of light strikes a floor surface spaced 7' 9.25" from said housing when said center mark indicator is positioned 5' 8" above the floor surface;

wherein said arcuate one of said walls is positioned against said perimeter edge of the dartboard and said center mark indicator is horizontally aligned with a bull's-eye of the dartboard, and wherein said dartboard is positioned such that said distance measuring assembly indicates said center mark indicator is 5' 8" from the floor surface.

6. The apparatus according to claim 5, wherein said distance measuring assembly includes:

a light emitter being directed outwardly of said bottom wall, said light emitter being a laser light emitter;

a detector being adapted for receiving light emitted by said light emitter that is reflected off of said selectable point;

a processor being electrically coupled to said detector and said light emitter and being adapted for determining the distance between said center mark indicator and said selectable point; and a display being mounted on said housing and being electrically coupled to said processor, said display being adapted for displaying the distance determined by said processor.

7. The apparatus according to claim 5, wherein said distance measuring assembly includes:

a sound emitter being directed outwardly of said bottom wall;

a detector being adapted for receiving sound emitted by said sound emitter that is reflected off of said selectable point;

a processor being electrically coupled to said detector and said sound emitter and being adapted for determining the distance between said center mark indicator and said selectable point; and a display being mounted on said housing and being electrically coupled to said processor, said display being adapted for displaying the distance determined by said processor.

* * * * *